US006314620B2

(12) United States Patent
Leder et al.

(10) Patent No.: US 6,314,620 B2
(45) Date of Patent: Nov. 13, 2001

(54) CLEANING DEVICE FOR TRAVELING FLATS OF A CARDING MACHINE

(75) Inventors: Armin Leder, Mönchengladbach; Gerd Pferdmenges, Jüchen, both of (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/832,886

(22) Filed: Apr. 12, 2001

Related U.S. Application Data

(63) Continuation of application No. 09/747,433, filed on Dec. 26, 2000.

(30) Foreign Application Priority Data

Dec. 24, 1999 (DE) ..... 199 63 082

(51) Int. Cl.[7] ..... D01G 15/02
(52) U.S. Cl. ..... 19/102; 19/107; 19/111
(58) Field of Search ..... 19/98, 102, 105, 19/106 R, 107, 108, 109, 111, 113, 114

(56) References Cited

U.S. PATENT DOCUMENTS 3,321,810 * 5/1967 Burnham ..... 19/107
3,376,610 * 4/1968 Williams ..... 19/107
3,387,336 * 6/1968 Crowley, Jr. ..... 19/107
3,387,337 * 6/1968 Crowley, Jr. ..... 19/107
4,196,497 * 4/1980 Beneke et al. ..... 19/107
4,353,149 * 10/1982 Demuth et al. ..... 19/107
4,368,561 * 1/1983 Trutzschler ..... 19/111
4,759,102 * 7/1988 Verzilli et al. ..... 19/111
4,771,514 * 9/1988 Verzilli ..... 19/109
4,945,609 * 8/1990 Hauschild et al. ..... 19/102
5,259,092 * 11/1993 Lambe et al. ..... 19/109
6,052,871 * 4/2000 Patelli et al. ..... 19/109
6,167,594 * 1/2001 Steinert ..... 19/111

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A carding machine includes flat bars traveling in an endless path. First and second end rolls periodically reverse the travel direction of each flat bar. First and second drive shafts carry and rotate the respective first and second end rolls. An apparatus for cleaning the flat bars includes a throughgoing, eccentric aperture provided in a radial wall of the first end roll. At any time at least two mutually adjoining flat bars, situated on the first end roll, are aligned at least partially with the aperture. A suction inlet adjoins the radial wall of the first end roll for being periodically brought into alignment with the aperture as the first end roll rotates. A suction chamber is formed by a space bounded by the adjoining flat bars and a surface of the first drive shaft.

9 Claims, 3 Drawing Sheets

CLEANING DEVICE FOR TRAVELING FLATS OF A CARDING MACHINE

CROSS REFERENCE TO RELATED APPLICATION

This application is a continuation of U.S. application Ser. No. 09/747,433 filed Dec. 26, 2000.

This application claims the priority of German Application No. 199 63 082.8 filed Dec. 24, 1999, which is incorporated herein by reference.

BACKGROUND OF THE INVENTION

This invention relates to a device for cleaning traveling flat bars circulating in a carding machine. The flat bars are mounted on an endless carrier supported on end sprockets which periodically reverse the direction of travel of the flat bars. At least at one region of reversal a chamber-like suction device is arranged which is coupled to a suction source and has a suction opening.

In a known apparatus, as described in European Patent No. 0 366 948, to which corresponds U.S. Pat. No. 4,945,609, at one location of reversal, coaxially with the center of curvature, an elongated suction pipe is provided which is situated between the two end sprockets and extends along the width of the carding machine, that is, along the length of the traveling flats. At one end face the suction pipe terminates in a flange to be coupled to a suction source. A suction slot is provided in the suction pipe along the entire length thereof.

The above-outlined prior art construction has the following disadvantages:

The sole suction slot has only a slight suction effect. Further, the suction pipe is an additional structural component which is difficult to install in the zone of reversal where the sprocket drive shaft is positioned, thus rendering the apparatus complex and expensive. To avoid undesired air flows and to reduce the air consumption, additional measures are required such as the provision of sealing lips mounted on the back of the flat bars for sliding on the suction pipe. Also, the coupling to the suction source must be guided around the traveling flats sprockets.

SUMMARY OF THE INVENTION

It is an object of the invention to provide an improved apparatus of the above-outlined type from which the discussed disadvantages are eliminated and which, in particular, is simple to construct and assemble and results in a better cleaning efficiency.

This object and others to become apparent as the specification progresses, are accomplished by the invention, according to which, briefly stated, the carding machine includes a traveling flats assembly which has a plurality of flat bars traveling in an endless path. The flat bars are spaced from one another in a travel direction thereof. First and second end rolls periodically reverse the travel direction of each flat bar. At any time a plurality of flat bars are situated in a circular array on each end roll for being carried in a circular path thereby. First and second drive shafts carry and rotate the respective first and second end rolls. An apparatus for cleaning the flat bars is arranged in a region of at least the first end roll. The apparatus includes a throughgoing, eccentric aperture provided in a radial wall of the first end roll. At any time at least two mutually adjoining flat bars, situated on the first end roll, are aligned at least partially with the aperture. A suction inlet adjoins the radial wall of the first end roll for being periodically brought into alignment with the throughgoing aperture upon rotation of the first end roll. A suction chamber is formed by a space bounded by the adjoining flat bars and a peripheral surface of the first drive shaft.

By providing a vacuum chamber formed by adjoining outer surfaces of the flat bars and the drive shaft, that is, already existing structural elements are being utilized, the structural and mounting outlay is significantly reduced as compared to prior art arrangements. A suction chamber provided in this manner has a small cross section whereby a higher flow velocity is achieved which, in turn, leads to an increased cleaning effect. The suction source may be arranged without spatial problems at the outer side of the end sprocket and may draw air in this manner through the suction openings. Further, advantageously, the tooth gaps of the end sprocket may be exposed to a suction stream and may thus be cleaned.

DESCRIPTION OF THE PREFERRED EMBODIMENTS

Figure 1:
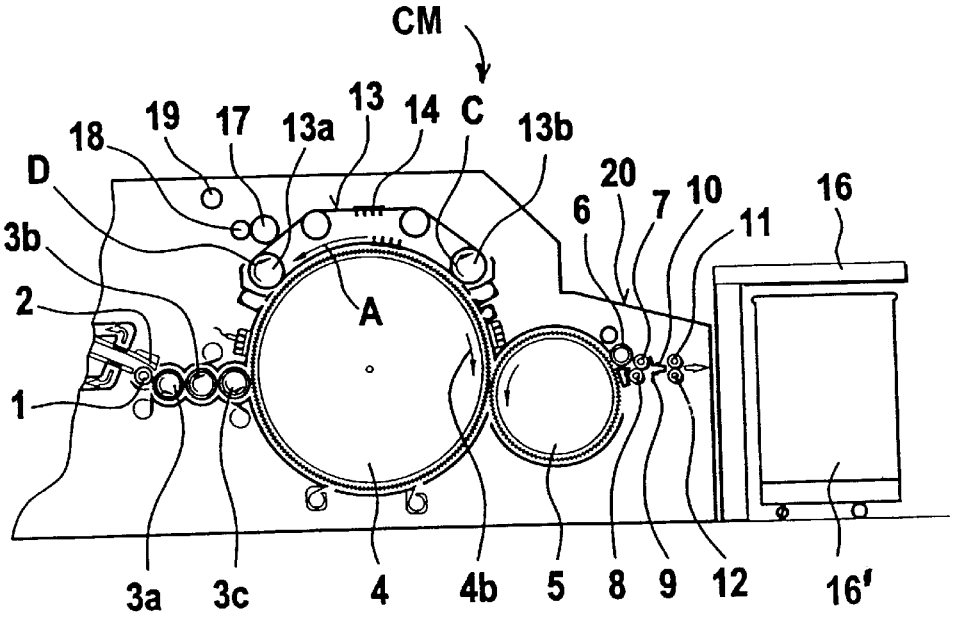
FIG. 1 is a schematic side elevational view of a carding machine incorporating the invention.

FIG. 1 shows a carding machine CM which may be, for example, a DK 903 high-performance carding machine manufactured by Trützschler GmbH & Co. KG, M önchengladbach, Germany. The carding machine CM has a feed roll 1, a feed table 2 cooperating with the feed roll 1, licker-ins 3*a*, 3*b*, 3*c*, a main carding cylinder 4, a doffer 5, a stripping roll 6, crushing rolls 7, 8, a web guiding element 9, a sliver trumpet 10, calender rolls 11, 12 and a traveling flats assembly 13 having slowly circulating flat bars 14 which move approximately at between 0.05 and 0.4 m/min. The flat bars 14 are at opposite longitudinal ends thereof coupled to respective, non-illustrated, parallel-arranged endless circulating belts trained about end rollers, such as end rolls (end sprockets) 13*a*, 13*b*. Also referring to FIG. 2, the flat bars 14 are pulled by the belts in the working direction A over non-illustrated bends and they reverse direction by means of the end sprocket 13*a* rotating in the direction D and continue their travel in the idling direction B. Then the end sprocket 13*b*, rotating in the direction C once again advances the flat bars 14 in the working direction A. The direction of rotation of the rolls of the carding machine are shown by curved arrows drawn therein. At the outlet of the carding machine CM a sliver coiler 16 is positioned for depositing sliver into the coiler can 16'. On the return travel side the flat bars 14, as they move in the idling direction B, are exposed to slowly rotating flat bar brushes 17 for cleaning the flat bar clothings 14'. The flat bar brush 17 cooperates with a rapidly rotating cleaning roll 18. A suction device 19 draws debris, dust, short fibers and the like from the inner space underneath the cover 20 of the card.

Figure 2:
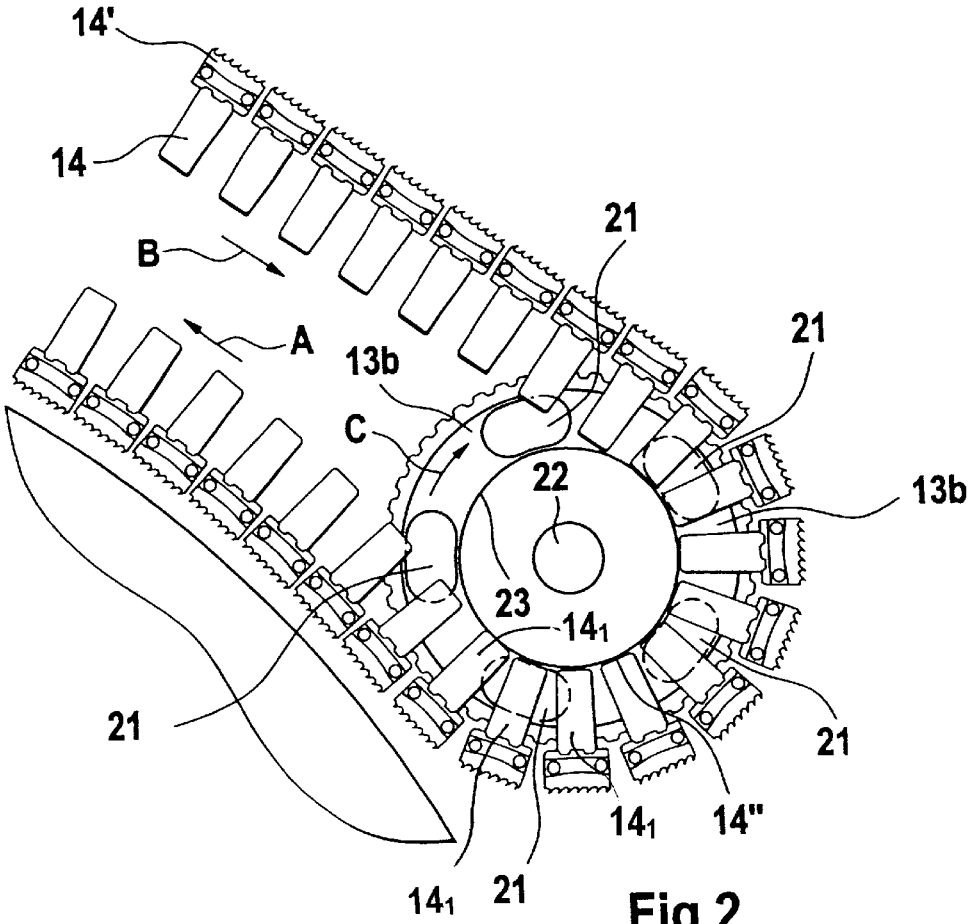
FIG. 2 is a side elevational view of an end region of traveling flats at the frontal end sprocket.

According to FIG. 2 the frontal sprocket 13*b* (as well as the non-illustrated other frontal sprocket supporting the other belt connected with the respective opposite longitudinal ends of the flat bars 14) has five circumferentially distributed throughgoing elongated openings 21. On the outer circumferential surface of the drive shaft 22 a yielding cylindrical jacket 23 (made, for example, of foam material) is arranged. The outer surface of the jacket 23 is in airtight engagement with the back face 14" of those flat bars 14 which, during the course of their travel, are situated on the sprocket 13*b*. By virtue of this arrangement, the suction chamber between two adjoining flat bars 14 has narrow limits and has a small volume.

Figure 3:
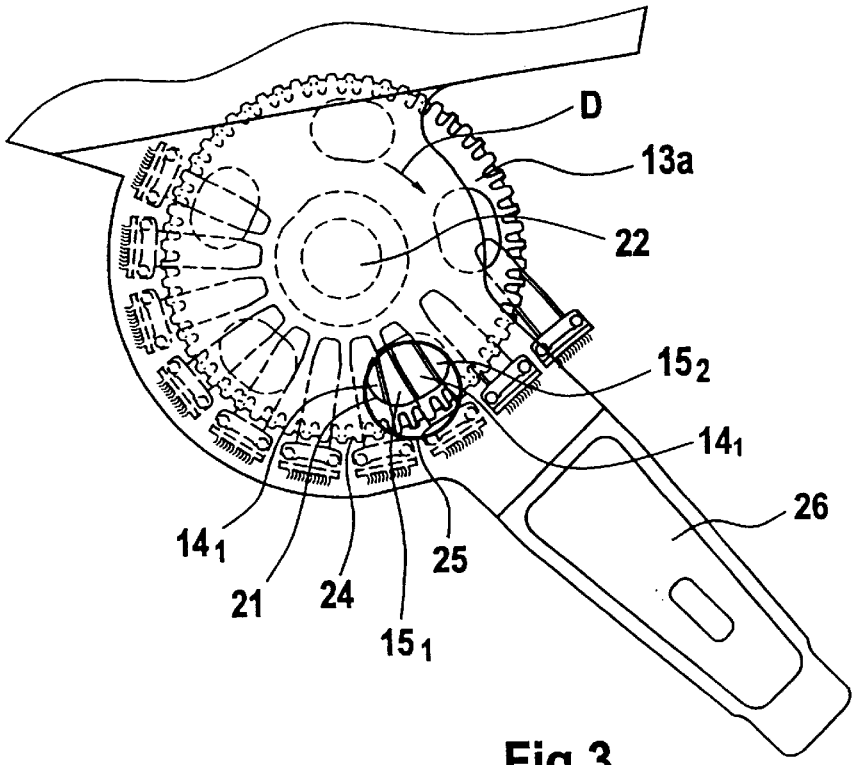
FIG. 3 is a side elevational view of the rear end sprocket of the traveling flats.
Figure 4:
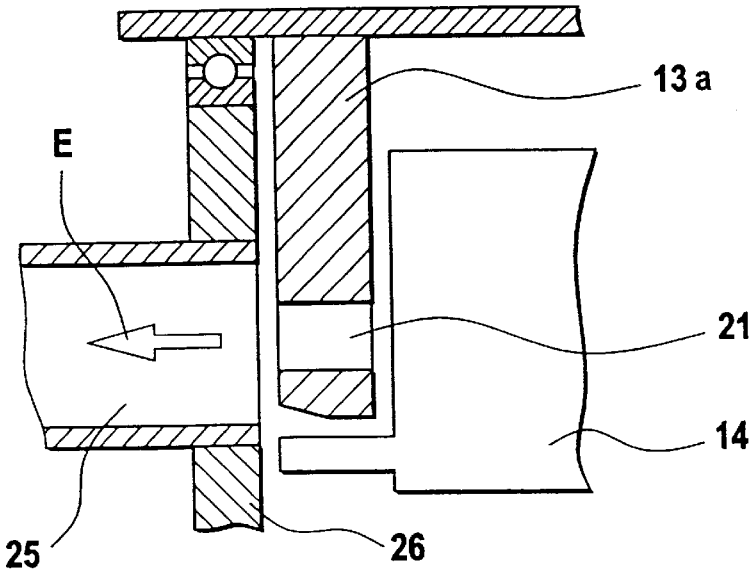
FIG. 4 is a sectional top plan view of one part of the construction shown in FIG. 3.

FIG. 3 shows the same arrangement for the rear belt sprocket 13*a* and is duplicated for the other, non-illustrated rear belt sprocket at the opposite end of the flat bars. As also shown in FIG. 4, the inlet opening of a suction pipe 25 is located close to the outer face (radial wall) of the sprocket and is aligned with the elongated openings 21 as they pass by. The inlet opening of the suction pipe 25 is situated in the region where the direction of travel of the flats is reversed and draws air through the sprocket 13*a* of the traveling flats drive. Thus, as it may also be observed in FIG. 2, the suction chamber $\mathbf{15}_1$ is composed by two adjoining flats bars $\mathbf{14}_1$ which at least partially extend within the outline of the inlet opening of the suction pipe 25 and the jacket 23 surrounding the sprocket drive shaft 22. Since the locations of suction have a small cross section, a high flow velocity is obtained. As the end sprocket rotates, the location of suction is closed in the intermediate traveling bar space and thus the soiled sprocket tooth gaps are exposed to suction. A suction nipple 25 is coupled to a non-illustrated suction source. An adjustable setting flange 26 is affixed to the suction nipple 25 and is mounted on the frame of the carding machine.

Particularly referring to FIGS. 2, 3 and 4, the suction nipple 25 of the suction source immediately adjoins the outer side of the end sprocket 13*a*. The suction chambers $\mathbf{15}_1$, $\mathbf{15}_2$ are formed essentially by the drive shaft 22 and the space between the outer faces of any two adjoining flat bars $\mathbf{14}_1$ which are simultaneously at least partially within the outline of an opening 21 and, at the same time, are located within the outline of the suction nipple 25.

Thus, as the end sprocket 13*a* and/or 13*b* associated with a suction arrangement according to the invention rotate, consecutively different suction chambers $\mathbf{15}_1$ arrive into the region of the suction nipple 25 whereby the dust laden air (arrow E in FIG. 4) is drawn from the suction chamber $\mathbf{15}_1$ (see FIG. 3) through the elongated end sprocket opening 21 into the suction nipple 25. FIG. 3 furthermore shows that the tooth gaps 24 between the teeth of the end sprocket are also exposed to suction and are thus cleaned.

By virtue of the non-continuous mode of operation, a vacuum fluctuation is obtained. This prevents, among others, an adherence or winding of the fibers on the structural components such as the sprockets 13*a* and/or 13*b*, the flat bars 14 and the flat bar drive belts.

Figure 5:
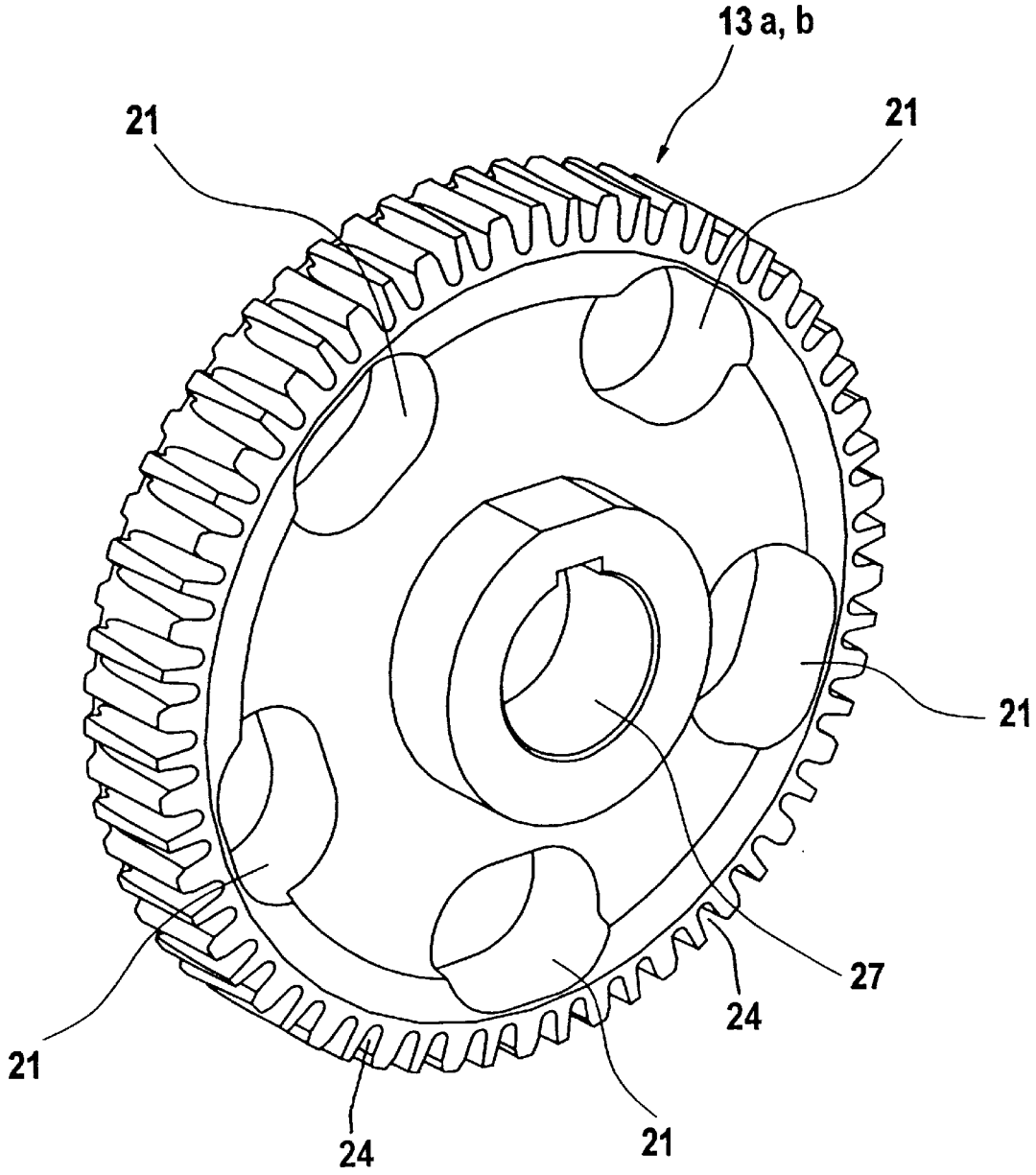
FIG. 5 is a perspective view of an end sprocket including five through openings exposed to a suction stream.

FIG. 5 shows in perspective view one end sprocket 13*b* according to the invention to more clearly illustrate the tooth gaps 24 between adjoining sprocket teeth and the five elongated suction apertures 21. The drive shaft not shown in FIG. 5 is adapted to pass through the central sprocket opening 27.

The suction may take place bilaterally on the right and left-hand side of the machine or may be effected only at a single machine side. Preferably such a suction is effected from the left-hand machine side since there the drive need not be circumvented. In case of a bilateral suction structure, in the middle of the suction chamber normally a dead spot would be formed which, however, is eliminated due to the fluctuating suction according to the invention. In case of unilateral suction on the other side, the suction stream may advantageously be enhanced by air pressure pulses in which case the component 25 is, at such other side, functioning as a pneumatic pressure outlet.

It will be understood that the above description of the present invention is susceptible to various modifications, changes and adaptations, and the same are intended to be comprehended within the meaning and range of equivalents of the appended claims.

What is claimed is:

1. A carding machine comprising (a) a traveling flats assembly including (1) a plurality of flat bars traveling in an endless path; said flat bars being spaced from one another in a travel direction thereof;

(2) first and second end rolls for periodically reversing said travel direction; each said end roll having a radial wall; at any time a plurality of flat bars being situated in a circular array on each said end roll for being carried in a circular path thereby; and (3) first and second drive shafts carrying and rotating respective said first and second end rolls; and (b) an apparatus for cleaning said flat bars; said apparatus being arranged in a region of at least said first end roll; said apparatus comprising (1) a throughgoing, eccentric aperture provided in said radial wall of said first end roll; at least two mutually adjoining flat bars, situated on said first end roll, being aligned at least partially with said aperture;

(2) a suction inlet adjoining said radial wall of said first end roll for being periodically brought into alignment with said throughgoing aperture upon rotation of said first end roll; and (3) a suction chamber formed by a space bounded by said adjoining flat bars and a peripheral surface of said first drive shaft.

2. The carding machine as defined in claim 1, wherein there are provided 3 to 5 circumferentially spaced throughgoing apertures in the radial wall of said first end roll.

3. The carding machine as defined in claim 2, wherein said apertures are elongated in a circumferential direction of said first end roll.

4. The carding machine as defined in claim 1, wherein the number of said throughgoing apertures is five and a circumferential distribution thereof and that of said flat bars located on said first end roll is such that that every third to fifth suction chamber is exposed to suction through said suction inlet.

5. The carding machine as defined in claim 1, wherein said radial wall has a radial surface oriented away from said flat bars; said suction inlet facing said radial surface.

6. The carding machine as defined in claim 1, wherein said suction inlet is stationarily supported.

7. The carding machine as defined in claim 1, further comprising a resilient jacket surrounding said drive shaft and having a cylindrical outer face; each said flat bar having a back surface engaging air tight said cylindrical outer face of said jacket when located on said first end roll.

8. A carding machine comprising (a) a traveling flats assembly including (1) a plurality of flat bars traveling in an endless path; said flat bars being spaced from one another in a travel direction thereof; each flat bar having a length oriented transversely to said travel direction and opposite ends defining said length;

(2) first and second end roll assemblies for periodically reversing said travel direction; each said end roll assembly having first and second end rolls spaced from one another parallel to the flat bar lengths; each said end roll having a radial wall; at any time a plurality of flat bars being situated in a circular array about each said end roll for being carried in a circular path thereby; and (3) first and second drive shafts carrying and rotating respective said first and second end roll assemblies; and (b) an apparatus for cleaning said flat bars; said apparatus being arranged in a region of at least said first end roll assembly; said apparatus comprising (1) a throughgoing, eccentric aperture provided in said radial wall of said first and second end rolls of said first end roll assembly; at least two mutually adjoining flat bars, situated about said first end roll assembly, being aligned at least partially with said aperture of said first and second end rolls of said first end roll assembly;

(2) a respective suction inlet adjoining said radial wall of said first and second end rolls of said first end roll assembly for being periodically brought into alignment with said throughgoing aperture upon rotation of said first end roll assembly; and (3) suction chambers formed by a space bounded by said adjoining flat bars and a peripheral surface of said first drive shaft.

9. A carding machine comprising (a) a traveling flats assembly including (1) a plurality of flat bars traveling in an endless path; said flat bars being spaced from one another in a travel direction thereof; each flat bar having a length oriented transversely to said travel direction and opposite ends defining said length;

(2) first and second end roll assemblies for periodically reversing said travel direction; each said end roll assembly having first and second end rolls spaced from one another parallel to the flat bar lengths; each said end roll having a radial wall; at any time a plurality of flat bars being situated in a circular array about each said end roll for being carried in a circular path thereby; and (3) first and second drive shafts carrying and rotating respective said first and second end roll assemblies; and (b) an apparatus for cleaning said flat bars; said apparatus being arranged in a region of at least said first end roll assembly; said apparatus comprising (1) a throughgoing, eccentric aperture provided in said radial wall of said first and second end rolls of said first end roll assembly; at least two mutually adjoining flat bars, situated about said first end roll assembly, being aligned at least partially with said aperture of said first and second end rolls of said first end roll assembly;

(2) a suction inlet adjoining said radial wall of said first end roll of said first end roll assembly for being periodically brought into alignment with said throughgoing aperture upon rotation of said first end roll assembly;

(3) a pneumatic pressure outlet adjoining said radial wall of said second end roll of said first end roll assembly for being periodically brought into alignment with said throughgoing aperture upon rotation of said first end roll assembly; and (4) suction chambers formed by a space bounded by said adjoining flat bars and a peripheral surface of said first drive shaft.

* * * * *